US009368306B2

(12) United States Patent
Hollner et al.

(10) Patent No.: US 9,368,306 B2
(45) Date of Patent: Jun. 14, 2016

(54) CONFIGURABLE MULTI-POLE RELAY

(71) Applicant: ABL IP Holding LLC, Conyers, GA (US)

(72) Inventors: Lance J. Hollner, Chatsworth, CA (US); Stephen Haight Lydecker, Conyers, GA (US)

(73) Assignee: ABL IP Holding LLC, Decatur, GA (US)

( * ) Notice: Subject to any disclaimer, the term of this patent is extended or adjusted under 35 U.S.C. 154(b) by 290 days.

(21) Appl. No.: 14/175,661

(22) Filed: Feb. 7, 2014

(65) Prior Publication Data

US 2014/0246299 A1 Sep. 4, 2014

Related U.S. Application Data

(60) Provisional application No. 61/762,134, filed on Feb. 7, 2013.

(51) Int. Cl.
*H01H 9/26* (2006.01)
*H01H 71/10* (2006.01)

(52) U.S. Cl.
CPC ..... *H01H 71/1009* (2013.01)

(58) Field of Classification Search
CPC ..... H01H 71/1009
USPC ..... 200/5 A, 293, 294, 50.01, 50.11, 50.2; 361/600, 631, 634, 645, 652, 673, 647, 361/679.01, 809, 825; 335/202; 439/723–724, 716
See application file for complete search history.

(56) References Cited

U.S. PATENT DOCUMENTS

| | | | | |
|---|---|---|---|---|
| 3,193,646 | A | 7/1965 | Krebs et al. | |
| 3,328,553 | A | 6/1967 | Gryctko | |
| 3,505,621 | A | 4/1970 | Knecht | |
| 4,166,988 | A | 9/1979 | Ciarcia et al. | |
| 4,760,483 | A | 7/1988 | Kugelman et al. | |
| 4,980,525 | A | 12/1990 | Kakisako | |
| 5,109,142 | A | 4/1992 | Von Kannewurff et al. | |
| 5,164,694 | A | 11/1992 | DeVault et al. | |
| 5,166,651 | A | 11/1992 | Jacobs et al. | |
| 5,172,087 | A | 12/1992 | Castonguay et al. | |
| 5,214,402 | A | 5/1993 | DiVincenzo et al. | |
| 5,569,894 | A | 10/1996 | Uchida et al. | |
| 5,686,709 | A | 11/1997 | Casagrande et al. | |
| 5,753,878 | A | 5/1998 | Doughty et al. | |
| 5,838,219 | A | 11/1998 | Du et al. | |
| 6,137,069 | A | 10/2000 | Casagrande et al. | |
| 6,222,147 | B1 | 4/2001 | Doughty et al. | |
| 6,531,938 | B1 | 3/2003 | Smith et al. | |
| 7,286,340 | B2 * | 10/2007 | Karim | H02B 1/042 200/294 |
| 7,403,373 | B2 * | 7/2008 | McCoy | H02B 1/042 200/294 |

(Continued)

*Primary Examiner* — Edwin A Leon
(74) *Attorney, Agent, or Firm* — Kilpatrick Townsend & Stockton, LLP

(57) ABSTRACT

In some aspects, a configurable multi-pole relay system is provided. The configurable multi-pole relay system can include a first relay module, a second relay module, and a connecting structure. The first relay module can include a first switch that can be electrically connected to a first electrical circuit. The second relay module can include a second switch that can be electrically connected to a second electrical circuit. The connecting structure can include first and second physical connectors. The first physical connector can be attached to a first interlocking portion of the first relay module. The second physical connector can be attached to a second interlocking portion of the second relay module.

16 Claims, 7 Drawing Sheets

(56) References Cited

U.S. PATENT DOCUMENTS

| | | | | |
|---|---|---|---|---|
| 7,598,833 | B1 | 10/2009 | Hodges et al. | |
| 7,679,478 | B2 | 3/2010 | McCoy | |
| 7,795,550 | B2 | 9/2010 | McCoy | |
| 7,812,695 | B2 | 10/2010 | McCoy | |
| 7,829,808 | B2 * | 11/2010 | Bogdon | H01H 71/0214 200/293 |
| 7,843,682 | B2 | 11/2010 | Leinen et al. | |
| 7,889,476 | B2 | 2/2011 | King, Jr. | |
| 8,253,044 | B2 | 8/2012 | Beatty, Jr. et al. | |
| 2006/0132269 | A1 | 6/2006 | Kadah | |
| 2007/0063796 | A1 | 3/2007 | Mattlar et al. | |
| 2008/0135390 | A1 | 6/2008 | McCoy | |
| 2012/0067849 | A1 | 3/2012 | Nazeri | |

* cited by examiner

CONFIGURABLE MULTI-POLE RELAY

CROSS-REFERENCE TO RELATED APPLICATIONS

This application claims priority to U.S. Provisional Application Ser. No. 61/762,134 filed Feb. 7, 2013 and titled "Configurable Multi-Pole Relay," the contents of which are hereby incorporated by reference.

FIELD OF THE INVENTION

The present invention is directed to powering electrical devices and more particularly relates to a configurable multi-pole relay system.

BACKGROUND

The installation of electrical wiring and equipment may involve installing electromechanical relays in a building or other structure. Electromechanical relays are used to switch electrical circuits between different states. For example, an electromechanical relay may include a switch in an electrical circuit that is used to switch the electrical circuit between an "ON" state in which current flows through the electrical circuit and an "OFF" state in which no current flows through the electrical circuit.

Multi-pole electromechanical relays may be used to simultaneously (or near simultaneously) change the respective states of multiple electrical circuits in an electrical system. For example, a multi-pole relay can have multiple switches that are electrically connected to different electrical circuits. The switches of the multi-pole relay may be actuated simultaneously (or near simultaneously) such that the different electrical circuits switch between states at or near the same time.

Prior solutions for providing multi-pole relays for use in a field environment present disadvantages. For example, a technician may not know the appropriate number of poles for a multi-pole relay in advance or may be tasked with modifying the electrical system to include additional electrical circuits for simultaneous actuation. In one example, a technician may mistakenly bring a two-pole relay to a job requiring a three-pole relay. In another example, modifying an electrical system that currently uses a two-pole relay such that the electrical system uses a three-pole relay may require removing an existing two-pole relay. These disadvantages associated with current multi-pole relays can increase the time and complexity involved in installing or modifying electrical systems.

It is therefore desirable to provide a configurable multi-pole relay system for installation in electrical systems.

SUMMARY

In some aspects, a configurable multi-pole relay system is provided. The configurable multi-pole relay system can include at least two relay modules and a connecting structure for connecting the relay modules together. The first relay module can include a first switch that can be electrically connected to a first electrical circuit. The second relay module can include a second switch that can be electrically connected to a second electrical circuit. The connecting structure can include first and second physical connectors. The first physical connector can be attached to a first interlocking portion of the first relay module. The second physical connector can be attached to a second interlocking portion of the second relay module.

These and other aspects, features and advantages of the present invention may be more clearly understood and appreciated from a review of the following detailed description and by reference to the appended drawings and claims.

DETAILED DESCRIPTION

Figure 1:
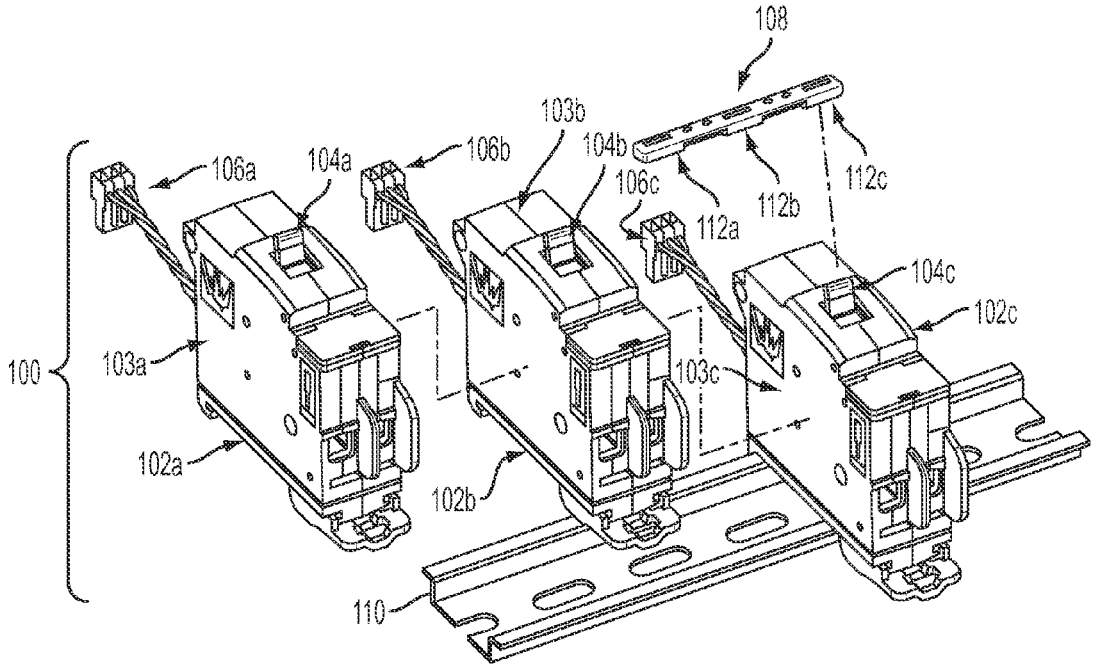
FIG. 1 is a perspective view depicting an example of a configurable multi-pole relay system.

Certain aspects of the invention provide a configurable multi-pole relay system. The configurable multi-pole relay system can include multiple relay modules, such as electromechanical relays. A connecting structure can physically connect or otherwise couple the relay modules together. For example, the connecting structure can include multiple physical connectors suitable for attachment to various interlocking portions of respective relay modules (e.g., manual switches for actuating the relay modules). A non-limiting example of a connecting structure can include a tie-bar or other connecting member. Connecting multiple relay modules to provide a configurable multi-pole relay system can accommodate the multi-pole specifications of particular installations.

In some aspects, the portions of the relay modules that interlock with the connecting structure can include actuating levers or other actuation mechanisms for the relay modules. In one non-limiting example, the physical connectors of the connecting structure may be receptacles into which corresponding actuating levers or other interlocking portions of the relay modules can be inserted. The receptacles can be sized such that inserting multiple actuating levers into respective receptacles of the connecting structure can allow the actuating levers of different relay modules to be moved together in a single physical motion. In other aspects, the physical connectors of the connecting structure can be protrusions that can be inserted into corresponding interlocking portions of the relay modules. For example, the connecting structure can include locking tabs that can be inserted into receptacles on the relay modules (e.g., portions of the actuating levers defining grooves that can receive the locking tabs).

In some aspects, a configurable multi-pole relay system can be installed in a control panel for a lighting system or another electrical system. A control panel can include slots for multiple single-pole modular relays. The multiple single-pole relay modules of the multi-pole relay system can be positioned in adjacent slots of the control panel. An installer can physically connect or couple (i.e., "link") adjacent single-pole relay modules with a tie-bar or other connecting structure. Physically connecting or otherwise coupling adjacent single-pole relay modules with a tie-bar or other connecting structure can provide a multi-pole relay system that can function as a multi-pole relay, such as (but not limited to) a two-pole relay or a three-pole relay. The multi-pole relay configuration can be selected by an installer in the field in accordance with lighting specifications or other electrical specifications for a building or other structure.

Detailed descriptions of certain aspects and examples are discussed below. These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative examples but, like the illustrative aspect examples, should not be used to limit the present invention.

FIG. 1 is a perspective view depicting an example of a configurable multi-pole relay system 100. The multi-pole relay system 100 depicted in FIG. 1 includes three relay modules 102*a-c*. The relay modules 102*a-c* can include respective housings 103*a-c*, respective actuating levers 104*a-c*, and respective electrical connectors 106*a-c*. A respective switching mechanism for each of the relay modules 102*a-c* can be disposed within each of the housings 103*a-c*, as described below with respect to FIGS. 6-7. Each of the actuating levers 104*a-c* can be a mechanically actuated throw for actuating a respective switching mechanism for a respective one of the relay modules 102*a-c* between an "ON" and "OFF" position. Each of the electrical connectors 106*a-c* can be configured to electrically connect a respective one of the relay modules 102*a-c* to an electrical system. In some aspects, each of the relay modules 102*a-c* can be positioned adjacent to one another along a rail 110 used for installing control equipment inside control panels or other equipment racks, such as (but not limited to) a DIN rail.

In some aspects, software configuration can be performed on control electronics to which the multi-pole relay system 100 can be electrically connected. A respective driving circuit or other device in the control electronics can be configured to output a driving signal to one or more of the relay modules 102*a-c*. The driving circuits or other devices can be configured via software to provide a synchronized driving circuit to all of the relay modules 102*a-c*. Providing a synchronized driving circuit to all of the relay modules 102*a-c* can allow the relay modules 102*a-c* to be cycled or otherwise actuated simultaneously as a single multi-pole relay system.

A connecting structure 108 can be used to physically connect or otherwise couple the relay modules 102*a-c* to form the multi-pole relay system 100. The connecting structure 108 can be formed from any suitable rigid or semi-rigid material, such as (but not limited to) rubber or plastic. A non-limiting example of a connecting structure 108 is a snap-on bridging connector.

The connecting structure 108 can include three receptacles 112*a-c*. Each of the receptacles 112*a-c* can be formed to surround (in whole or in part) and engage a respective one of the actuating levers 104*a-c*. Each of the receptacles 112*a-c* can be formed to have a sufficient size that the receptacle contacts one or more edges of a corresponding actuating lever. The receptacles 112*a-c* contacting one or more edges of each of the actuating levers 104*a-c* can exert sufficient force to cause the connecting structure 108 to be retained in place.

In some aspects, the connecting structure 108 can be formed such that the receptacles 112*a-c* are integral with the connecting structure 108. In other aspects, the receptacles 112*a-c* can be separate structures that can be connected or otherwise coupled to the connecting structure 108. In some aspects, the receptacles 112*a-c* can have a fixed position along the length of the connecting structure 108. In other aspects, one or more of the receptacles 112*a-c* can have a movable position along the length of the connecting structure 108. A connecting structure 108 having movable receptacles can be configured for differently sized or differently spaced relay modules in the configurable multi-pole relay system 100.

Figure 2:
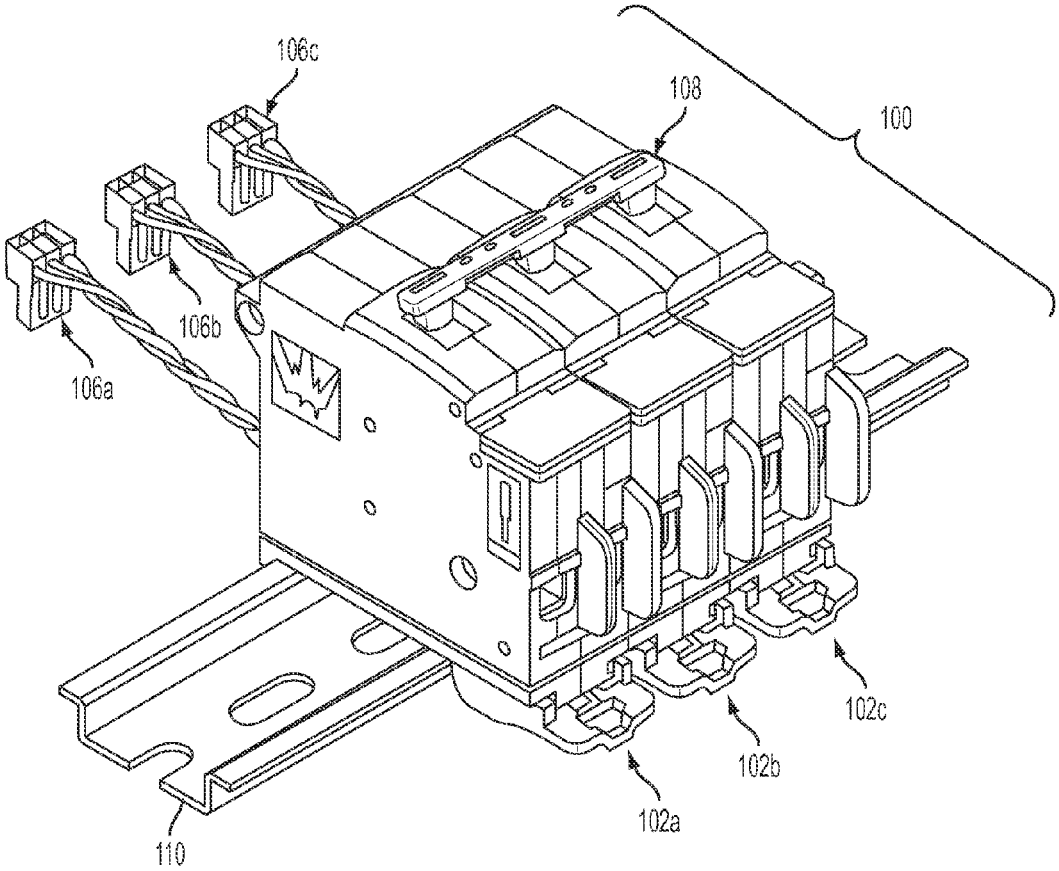
FIG. 2 is a perspective view depicting the multi-pole relay system of FIG. 1 with the relay modules connected via a connecting structure.

FIG. 2 is a perspective view depicting the multi-pole relay system 100 with the relay modules 102*a-c* connected via the connecting structure 108. The electrical connectors 106*a-c* can be inserted into one or more outlets or other receivers for an electrical system.

The connecting structure 108 can be removed from the relay modules 102*a-c* by applying a force to the connecting structure 108 in a direction away from the relay modules 102*a-c*. Removing the connecting structure 108 can allow the relay modules 102*a-c* to be re-configured into a different multi-pole relay system, such as a relay system greater than or fewer than three poles, using a different connecting member with greater than or fewer than three receptacles. The connecting structure 108 being removable allows the connecting structure 108 to be removed and re-applied in the multi-pole relay system 100.

Figure 3:
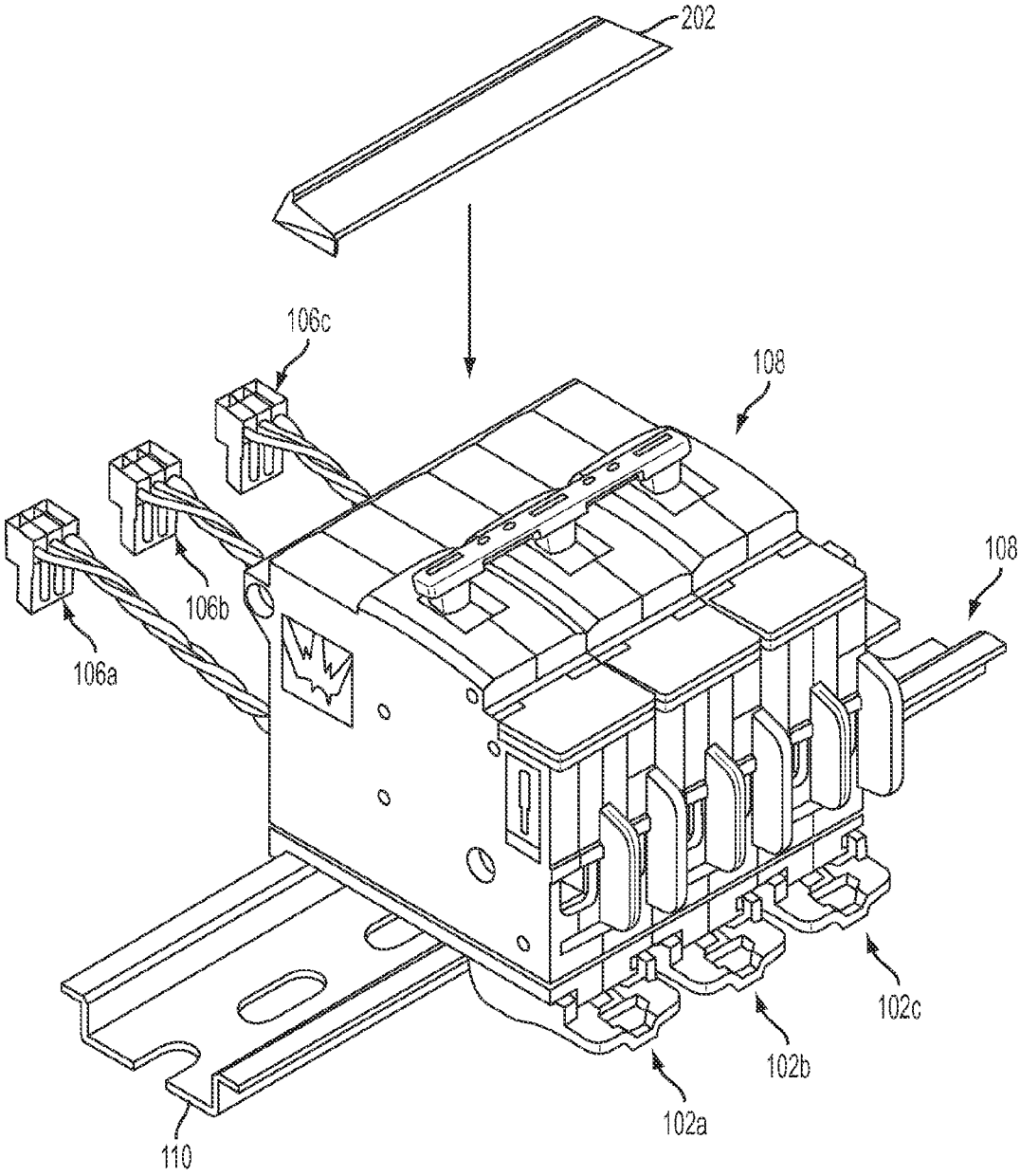
FIG. 3 is a perspective view depicting the multi-pole relay system of FIG. 1 with an additional connecting structure being positioned to connect the relay modules.
Figure 4:
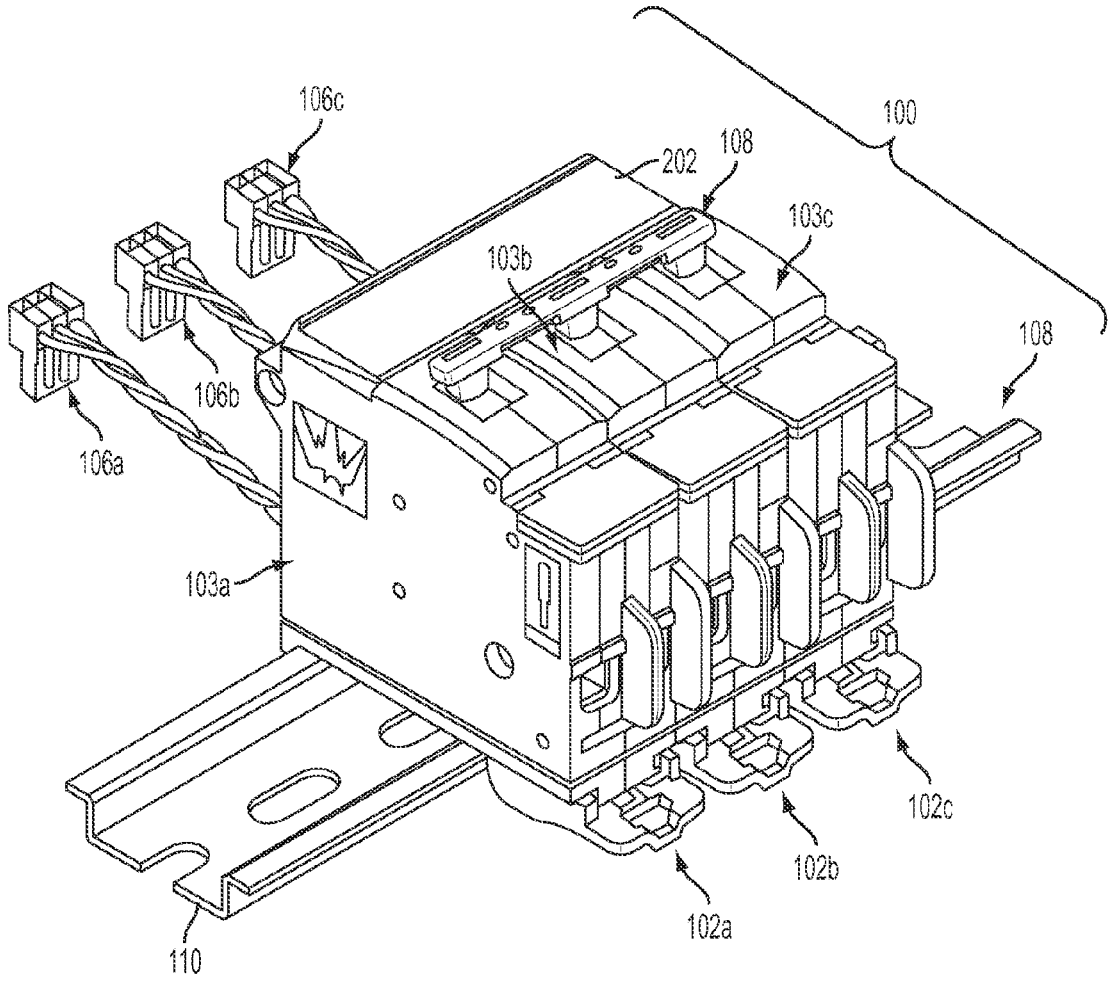
FIG. 4 is a perspective view depicting the multi-pole relay system of FIG. 3 with the additional connecting structure connecting the relay modules.

In additional or alternative aspects, the configurable multi-pole relay can include an additional connecting structure for connecting the relay modules 102*a-c* to on another. For example, FIG. 3 is a perspective view depicting an additional connecting structure 202 being positioned to connect the relay modules 102*a-c*. The relay modules 102*a-c* can be physically connected or otherwise coupled together by applying the additional connecting structure 202 to the relay modules 102*a-c*. For example, an additional connecting structure 202 such as an end cap can be positioned at a corner or along an edge of each of the relay modules 102*a-c*, as depicted in FIG. 4. The additional connecting structure 202 can connect the housings 103*a-c* together. The additional connecting structure 202 can be formed from any suitable rigid or semi-rigid material, such as plastic or rubber.

Figure 5:
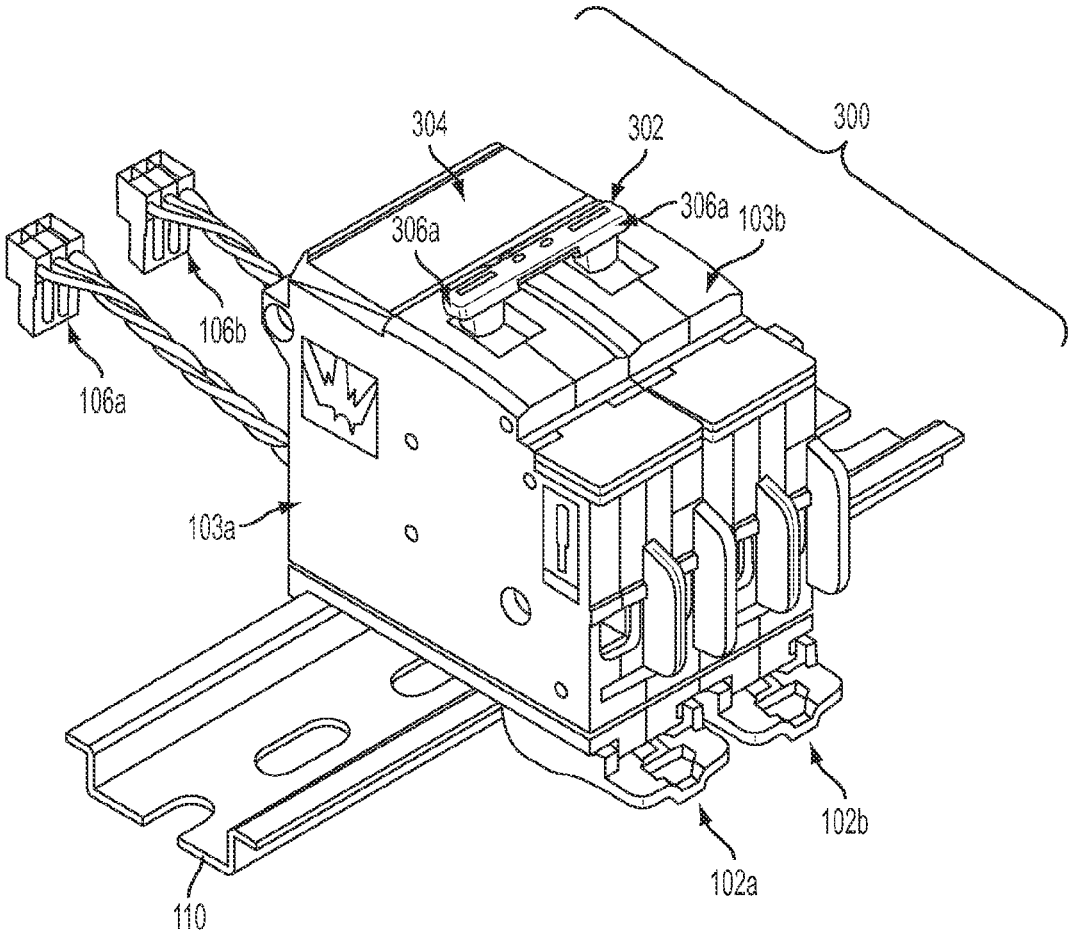
FIG. 5 is a perspective view depicting a configurable multi-pole relay system having two relay modules that are connectable via a connecting structure and an additional connecting structure.

Differently sized connecting structures can be selected for multi-pole relay systems having different numbers of relay modules. For example, FIG. 5 is a perspective view depicting a configurable multi-pole relay system 300 having two relay modules 102*a*, 102*b* that are connectable via a connecting structure 302 and an additional connecting structure 304. The connecting structure 302 can include two receptacles 306*a*, 306*b* for connecting the actuating levers of the relay modules 102*a*, 102*b*. The additional connecting structure 304 can be sized to connect the housings 103*a*, 103*b* together.

Although FIGS. 1-5 depict a configurable multi-pole relay system having two or three relay modules, any number of relay modules can be used.

Figure 7:
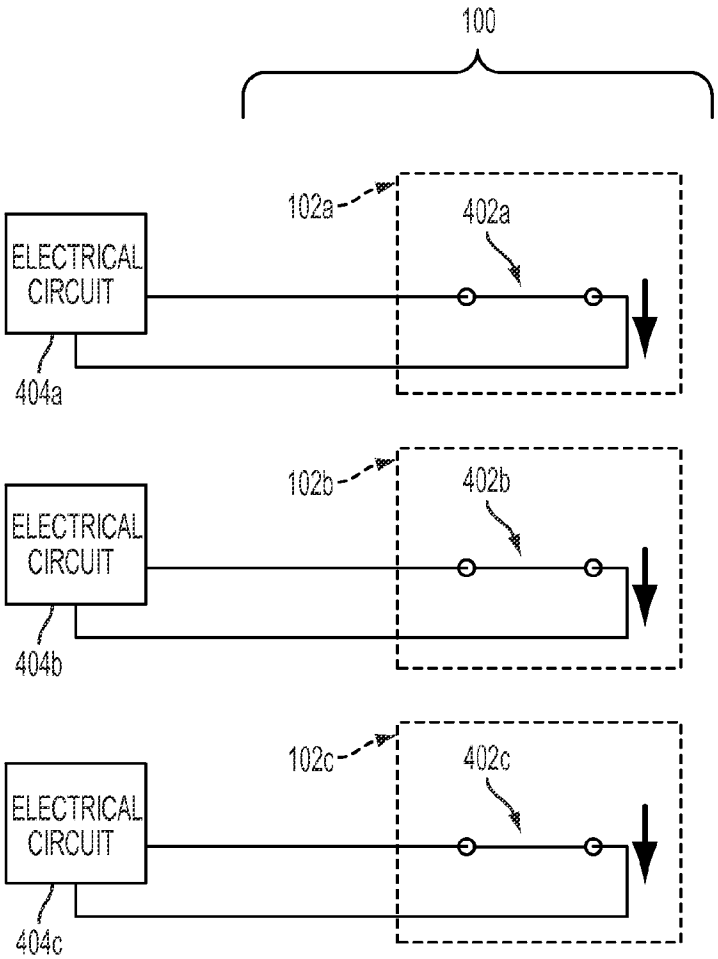
FIG. 7 is a partial block diagram depicting the configurable multi-pole relay system after actuation.
Figure 6:
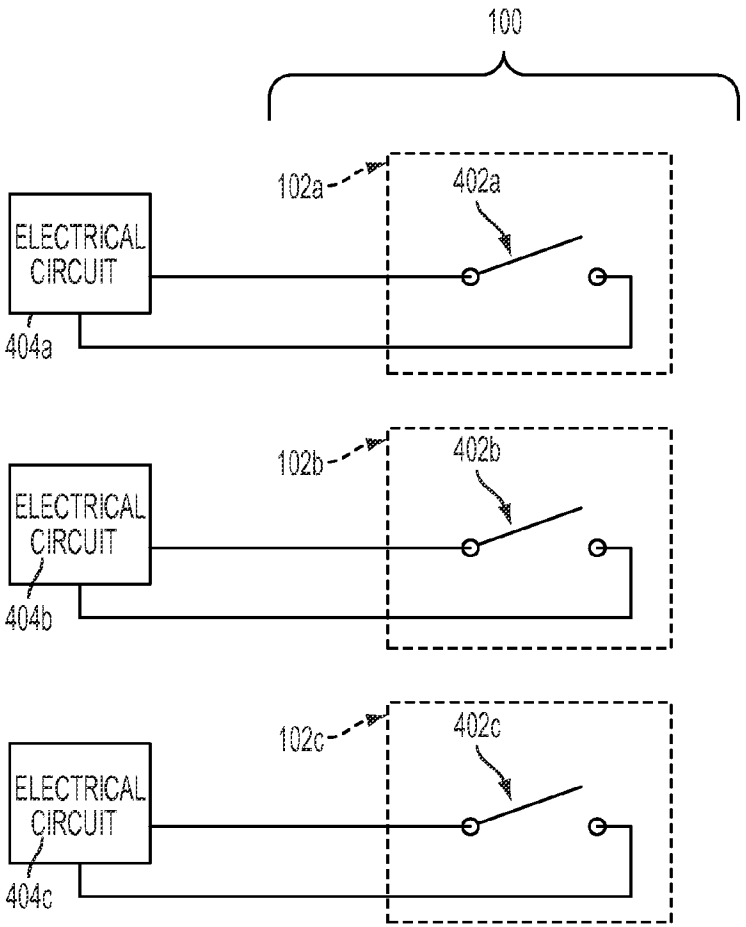
FIG. 6 is a partial block diagram depicting the operation of the configurable multi-pole relay system prior to actuation.

The configurable multi-pole relay system 100 allows multiple single-pole relays to be connected to form a multi-pole relay. For example, FIGS. 6-7 are partial block diagram depicting the operation of the multi-pole relay system 100. FIG. 6 is a partial block diagram depicting the configurable multi-pole relay system 100 prior to actuation. The relay modules 102*a-c* can respectively include switches 402*a-c*.

The switches 402*a-c* can be electrically connected to respective electrical circuits 404*a-c*, which may be electrical circuits in an electrical system in which the multi-pole relay system 100 is installed.

FIG. 7 is a partial block diagram depicting the configurable multi-pole relay system after actuation. Connecting the actuating levers 104*a-c* together with the connecting structure 108 can allow the switches 402*a-c* to be actuated simultaneously or near simultaneously. For example, the three switches may be set to a closed position simultaneously or near simultaneously, as depicted by the downward arrows in FIG. 7.

Using individual relay modules 102*a-c* to provide a configurable multi-pole relay system 100 can provide improved flexibility over a relay system having a fixed number of switches. In one example, although FIGS. 6-7 depict each of the relay modules 102*a-c* as including a respective single-pole, single-throw switch, other implementations are possible. For example, each of the relay modules 102*a-c* may include a double-pole switch. In some aspects, different ones of the relay modules 102*a-c* can include different types of switches. For example, of the relay modules 102*a-c* can include a single-pole switch and another of the of the relay modules 102*a-c* can include a double-pole switch. In another example, although FIGS. 6-7 depict each of the relay modules 102*a-c* being switched between the same states, other implementations are possible. For example, the same actuation action can be used to switch one of the relay modules 102*a-c* to an "ON" state and to simultaneously (or near simultaneously) switch another one of the relay modules 102*a-c* to an "OFF" state. Different ones of the relay modules 102*a-c* in the multi-pole relay system 100 can be configured by a technician to obtain the desired configuration of relay types and/or switching states.

Figure 8:
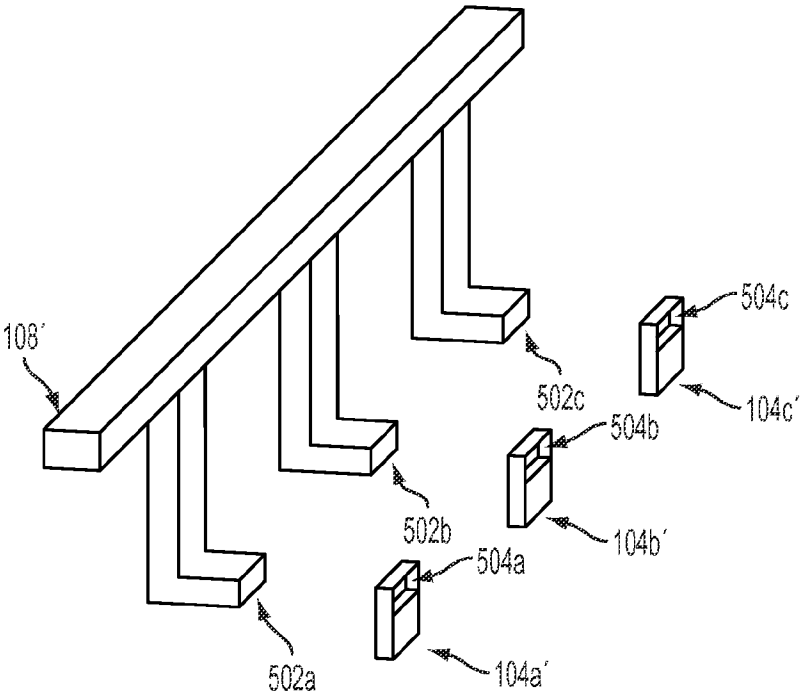
FIG. 8 is a perspective view depicting a connecting structure for an alternative configurable multi-pole relay system in which the connecting structure includes protrusions for insertion into receptacles of actuating levers of the relay modules.

Although FIG. 1 depicts a connecting structure 108 having receptacles 112*a-c* adapted to receive respective actuating levers 104*a-c*, other implementations are possible. For example, FIG. 8 is a perspective view depicting a connecting structure 108' having protrusions 502*a-c* that are adapted for insertion into respective receptacles 504*a-c* of respective actuating levers 104*a*'-c'. (For simplicity, FIG. 8 depicts the actuating levers 104*a*'-c' and omits other portions of the relay modules 102*a-c*.)

The connecting structure 108' and the protrusions 502*a-c* can be formed from any suitable rigid or semi-rigid material, such as (but not limited to) rubber or plastic. In some aspects, the protrusions 502*a-c* can be integral with the connecting structure 108'. In other aspects, the protrusions 502*a-c* can be separate structures that are attached to the connecting structure 108'. In some aspects, the protrusions 502*a-c* can have a fixed position with respect to one another. For example, the connecting structure 108' can be manufactured with the protrusions 502*a-c* in fixed positions for connecting relay modules 102*a-c* having specific widths. In other aspects, one or more of the protrusions 502*a-c* can be movable along a longitudinal axis or other length of the connecting structure 108'. Such movable protrusions can be used to use relay modules 102*a-c* having different widths in the same multi-pole relay system 100.

Each of the receptacles 504*a-c* can be formed to surround (in whole or in part) and engage a respective one of the protrusions 502*a-c*. Each of the receptacles 504*a-c* can be formed with a sufficient size that the receptacle contacts one or more edges of a corresponding protrusion. In some aspects, the receptacles 504*a-c* contacting one or more edges of the corresponding protrusions 502*a-c* can exert sufficient force to cause the connecting structure 108' to be retained in place. In other aspects, the protrusions 502*a-c* and/or the receptacles 504*a-c* can include additional structures, such as retaining or locking tabs, that can maintain each of the protrusions 502*a-c* in a fixed position within a respective one of the receptacles 504*a-c*.

In some aspects, the receptacles 504*a-c* can be integral with the actuating levers 104*a*'-c'. In other aspects, the receptacles 504*a-c* can be separate structures that are attached to the actuating levers 104*a*'-c' via any suitable process, such as applying an adhesive to the actuating lever or the structure defining the receptacle. In additional or alternative aspects, the receptacles 504*a-c* can be separate structures that are attached to the portions of the relay modules 102*a-c* other than the actuating levers 104*a*'-c'.

Figure 9:
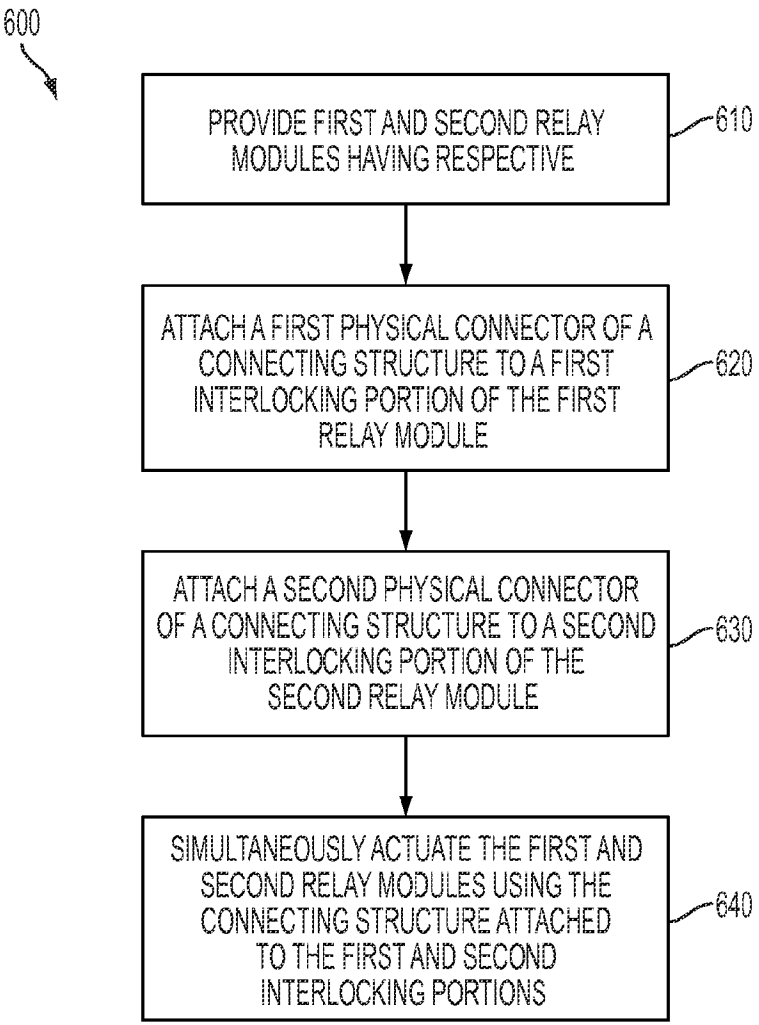
FIG. 9 is a flow chart illustrating an example method for providing a configurable multi-pole relay system.

FIG. 9 is a flow chart illustrating an example method 600 for providing a configurable multi-pole relay system. The method 600 can be implemented using one or more of implementations of the configurable multi-pole relay system 100 depicted in FIGS. 1-8 above. Other implementations, however, can be used.

The exemplary method 600 involves providing first and second relay modules having respective first and second switches that are electrically connectable to respective first and second electrical circuits, as depicted in block 610. For example, relay modules 102*a*, 102*b* can be selected for an electrical system by a technician. The relay modules 102*a*, 102*b* can be attached to a rail 110 at appropriate positions (e.g., adjacent to one another).

The exemplary method 600 further involves attaching a first physical connector of a connecting structure to a first interlocking portion of the first relay module, as depicted in block 620. In one non-limiting example, physical connectors of a connecting structure 108 can include receptacles 112*a-c*. An interlocking portion of a relay module 102*a* can be the actuating lever 104*a*. The connecting structure 108 can be attached to the relay module 102*a* by inserting the actuating lever 104*a* into one of the receptacles 112*a-c*. In another non-limiting example, a connecting structure 108' can include physical connectors such as protrusions 502*a-c*. An interlocking portion of a relay module 102*a* can be a receptacle 504*a* that is attached to or integral with the actuating lever 104*a*. The connecting structure 108 can be attached to the relay module 102*a* by inserting one of the protrusions 502*a-c* into the receptacle 504*a*.

The exemplary method 600 further involves attaching a second physical connector of the connecting structure to a second interlocking portion of the second relay module, as depicted in block 630. For example, an actuating lever 104*b* of a relay module 102*b* can be inserted into another one of the receptacles 112*a-c* of a connecting structure 108 or another one of the protrusions 502*a-c* of a connecting structure 108' can be inserted into a receptacle 504*b* of the actuating lever 104*b*.

The exemplary method 600 further involves simultaneously actuating the first and second relay modules using the connecting structure attached to the first and second interlocking portions, as depicted in block 640. For example, the connecting structure 108 being attached to actuating levers 104*a*, 104*b* can cause the relay modules 102*a*, 102*b* to be actuated simultaneously or near simultaneously.

In one non-limiting example, an electrical current can be provided to a coil or other actuating mechanism of a switch 402*a* of the relay module 102*a*. The switch 402*a* can be physically connected to the actuating lever 104*a*. The current provided to the coil or other actuating mechanism of a switch 402*a* can move the switch 402*a* between an "ON" position and an "OFF" position. The switch 402*a* being moved between the "ON" position and the "OFF" position can cause the actuating lever 104*a* to move between the "ON" position and the "OFF" position. The actuating lever 104*a* moving between the "ON" position and the "OFF" position can apply a force to the connecting structure 108 that is attached to the actuating lever 104*b* of the relay module 102*a*. The force applied to the connecting structure 108 can move the connecting structure 108. A physical connector of the connecting structure 108 being attached to the actuating lever 104*b* can cause a corresponding force to be applied to the actuating lever 104*b*. The force applied to the actuating lever 104*b* can cause the actuating lever 104*b* to move between an "ON" and an "OFF" position. The actuating lever 104*b* moving between an "ON" and an "OFF" position can cause a switch 402*b* of the relay module 102*b* to move between the "ON" position and the "OFF" position simultaneously (or near simultaneously) with the movement of the switch 402*a*.

In another non-limiting example, a force can be applied to a point along a connecting structure 108 that is attached to actuating levers 104*a*, 104*b*. The force applied to the connecting structure 108 can move the connecting structure 108. The physical connectors of the connecting structure 108 can cause a corresponding force to be applied to the actuating levers 104*a*, 104*b* such that the actuating levers 104*a*, 104*b* simultaneously (or near simultaneously) move between an "ON" and an "OFF" position.

In some aspects, the connecting structure 108 can have physical connectors (e.g., receptacles 112*a-c*, protrusions 502*a-c*) in fixed positions with respect to one another. A suitable connecting structure 108 for coupling the relay modules 102*a*, 102*b* together can be selected based on the positions of the physical connectors along the connecting structure 108. For example, a connecting structure can be selected based on the positions of the physical connectors corresponding to a distance between interlocking portions of the respective relay modules 102*a*, 102*b*, such as (but not limited to) the distance between the actuating levers 104*a*, 104*b* when the relay modules 102*a*, 102*b* are attached to a rail 110.

In other aspects, the connecting structure 108 can have physical connectors (e.g., receptacles 112*a-c*, protrusions 502*a-c*) that are movable along a length of the connecting structure 108. One or more of the physical connectors can be moved into an appropriate position such that the connecting structure 108 can couple the relay modules 102*a*, 102*b* together. For example, one or more of the physical connectors can be moved to positions along the connecting structure 108 such that a distance between the physical connectors corresponds to a distance between interlocking portions of the respective relay modules 102*a*, 102*b* (e.g., the distance between the actuating levers 104*a*, 104*b* when the relay modules 102*a*, 102*b* are attached to a rail 110).

The foregoing description of the examples, including illustrated examples, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention. The illustrative examples described above are given to introduce the reader to the general subject matter discussed here and are not intended to limit the scope of the disclosed concepts. The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below.

What is claimed is:

1. A configurable multi-pole relay system comprising:

a first relay module having a first switch that is electrically connectable to a first electrical circuit;

a second relay module having a second switch that is electrically connectable to a second electrical circuit; and a connecting structure comprising:

a plurality of physical connectors, one or more of the physical connectors having a movable position along a length of the connecting structure, a first physical connector adapted to attach to a first interlocking portion of the first relay module, the first physical connector positioned at a distance corresponding to the first interlocking position, and a second physical connector adapted to attach to a second interlocking portion of the second relay module.

2. The configurable multi-pole relay system of claim 1, wherein the first interlocking portion comprises a first actuating lever of the first relay module and second interlocking portion comprises a second actuating lever of the second relay module.

3. The configurable multi-pole relay system of claim 2, wherein the first physical connector comprises a first receptacle having a first size suitable for the first actuating lever to be inserted into the first receptacle and the second physical connector comprises a second receptacle having a second size suitable for the second actuating lever to be inserted into the second receptacle.

4. The configurable multi-pole relay system of claim 1, wherein the first physical connector comprises a first protrusion having a first size suitable for insertion into a first receptacle that is attached to or integral with the first interlocking portion and the second physical connectors comprises a second protrusion having a second size suitable for insertion into a second receptacle that is attached to or integral with the second interlocking portion.

5. The configurable multi-pole relay system of claim 4, wherein the first interlocking portion comprises a first actuating lever of the first relay module and the second interlocking portion comprises a second actuating lever of the second relay module.

6. The configurable multi-pole relay system of claim 1, wherein the second physical connector is attached to the connecting structure.

7. The configurable multi-pole relay system of claim 1, wherein the first switch is disposed in a first housing of the first relay module and the first interlocking portion is positioned external to the first housing;

wherein the second switch is disposed in a second housing of the second relay module and the second interlocking portion is positioned external to the second housing.

8. The configurable multi-pole relay system of claim 7, further comprising an additional connecting structure adapted to couple the first and second housings together.

9. A configurable multi-pole relay system comprising:

a first relay module having a first switch that is disposed within a first body and a first actuating lever configured for actuating the first switch, wherein the first switch is electrically connectable to a first electrical circuit;

a second relay module having a second switch that is disposed within a second body and a second actuating lever configured for actuating the second switch, wherein the second switch is electrically connectable to a second electrical circuit; and a connecting structure having a first physical connector adapted to attach to the first actuating lever and a second physical connector adapted to attach to the second actuating lever, wherein one or more of the first physical connector or the second physical connector has a movable position along a length of the connecting structure.

10. The configurable multi-pole relay system of claim 9, wherein the first physical connector comprises a first receptacle having a first size suitable for the first actuating lever to be inserted into the first receptacle and the second physical connector comprises a second receptacle having a second size suitable for the second actuating lever to be inserted into the second receptacle.

11. The configurable multi-pole relay system of claim 9, wherein the first physical connector comprises a first protrusion having a first size suitable for insertion into a first receptacle that is attached to or integral with the first actuating lever and the second physical connector comprises a second protrusion having a second size suitable for insertion into a second receptacle that is attached to or integral with the second actuating lever.

12. The configurable multi-pole relay system of claim 9, wherein one of the first physical connector or the second physical connector is integral with the connecting structure and has a respective position along the connecting structure levers.

13. A method comprising:

providing a first relay module having a first switch that is electrically connectable to a first electrical circuit;

providing a second relay module having a second switch that is electrically connectable to a second electrical circuit;

positioning a moveable first physical connector along a length of a connecting structure at a distance corresponding to a first interlocking position of the first relay module;

attaching the first physical connector positioned on the connecting structure to the first interlocking portion of the first relay module;

attaching a second physical connector of the connecting structure to a second interlocking portion of the second relay module; and simultaneously actuating the first and second relay modules using the connecting structure attached to the first and second interlocking portions.

14. The method of claim 13, wherein the first interlocking portion comprises a first actuating lever of the first relay module and the second interlocking portion comprises a second actuating lever of the second relay module.

15. The method of claim 13, further comprising selecting the connecting structure based on the connecting structure having the second physical connector at a position along the connecting structure corresponding to the second interlocking portion.

16. The method of claim 13, further comprising positioning the second physical connectors along the length of the connecting structure such that the second physical connector has a position along the connecting structure corresponding to the second interlocking portion.

* * * * *